US005390612A

United States Patent [19]

Toth

[11] Patent Number: 5,390,612

[45] Date of Patent: Feb. 21, 1995

[54] FLUIDIZED BED REACTOR HAVING A FURNACE STRIP-AIR SYSTEM AND METHOD FOR REDUCING HEAT CONTENT AND INCREASING COMBUSTION EFFICIENCY OF DRAINED FURNACE SOLIDS

[75] Inventor: Stephen J. Toth, Clinton Township, Hunterdon County, N.J.

[73] Assignee: Foster Wheeler Energy Corporation, Clinton, N.J.

[21] Appl. No.: 24,041

[22] Filed: Mar. 1, 1993

[51] Int. Cl.[6] ..... F23G 7/00

[52] U.S. Cl. ..... 110/245; 122/4 D

[58] Field of Search ..... 110/245; 122/4 D; 432/15, 58, 77

[56] References Cited

U.S. PATENT DOCUMENTS

| | | | |
|---|---|---|---|
| 3,662,719 | 5/1972 | Winkin . | |
| 4,227,488 | 10/1980 | Stewart et al. . | |
| 4,335,661 | 6/1982 | Stewart et al. | 122/4 D |
| 4,349,969 | 9/1982 | Stewart et al. | 110/245 |
| 4,397,102 | 8/1983 | Gamble et al. . | |
| 4,436,507 | 3/1984 | Stewart et al. . | |
| 4,446,629 | 5/1984 | Stewart et al. . | |
| 4,704,084 | 11/1987 | Liu et al. . | |
| 4,781,574 | 11/1988 | Taylor . | |
| 4,809,620 | 3/1989 | Cosca | 110/245 |
| 4,829,912 | 5/1989 | Alliston et al. . | |
| 4,947,804 | 8/1990 | Abdulally . | |
| 5,069,171 | 12/1991 | Hansen et al. | 110/245 |
| 5,078,065 | 1/1992 | Tsunemi et al. | 110/245 |
| 5,218,932 | 6/1993 | Abdulally | 122/4 D |
| 5,242,662 | 9/1993 | Toth | 122/4 D |

FOREIGN PATENT DOCUMENTS 2189164 10/1987 United Kingdom .

*Primary Examiner*—Henry C. Yuen

*Attorney, Agent, or Firm*—Marvin A. Naigur

[57] ABSTRACT

A fluidized bed reactor having a furnace strip-air system and method for reducing heat content and increasing combustion efficiency of drained furnace solids in which a bed of particulate material is supported in a furnace section. A portion of the bed receives a greater amount of fluidizing gas to increase the stoichiometric conditions in the bed portion, strip relatively fine material from the particulate material in the bed portion and increase the amount of heat transferred to the flue gases. A cooler is located adjacent the furnace section for receiving particulate material from the bed portion.

9 Claims, 2 Drawing Sheets

FLUIDIZED BED REACTOR HAVING A FURNACE STRIP-AIR SYSTEM AND METHOD FOR REDUCING HEAT CONTENT AND INCREASING COMBUSTION EFFICIENCY OF DRAINED FURNACE SOLIDS

BACKGROUND OF THE INVENTION

This invention relates to a fluidized bed reactor and method for operating same and, more particularly, to a fluidized bed reactor utilizing a strip-air system for reducing the heat content of, and removing the relatively fine particulate material from, the waste solids drained from the furnace section of the reactor while at the same time increasing the reactor's combustion efficiency.

Reactors, such as combustors, steam generators and the like, which utilize fluidized beds as their primary source of heat generation, are well known. In these arrangements, air is passed into the furnace section of the reactor and through a bed of particulate material contained therein which includes a mixture of a fossil fuel, such as coal, and an adsorbent, such as limestone, to adsorb the sulfur generated as a result of the combustion of the coal. The air fluidizes the bed and promotes the combustion of the fuel.

To improve the pollution characteristics of fluidized bed reactors, it is known to stage the combustion of the fuel by controlling the amount of oxygen in various regions of the fluidized bed. In general, the lower region of the fluidized bed is operated under fuel rich or substoichiometric conditions such that nitrogen oxides emissions are reduced. The upper region is then operated under oxygen rich or oxidizing conditions to complete the combustion of the fuel.

Each region of the fluidized bed is comprised of a homogenous mixture of particles of fuel and adsorbent, with a portion of the fuel particles being unburned, a portion being partially burned and a portion being completely burned; and a portion of the adsorbent being unreacted, a portion being partially reacted and a portion being completely reacted. The particulate material must be discharged from the system efficiently to accommodate the introduction of fresh fuel and adsorbent. To this end, a portion of the particulate material is usually passed from the lower region of the bed through a drain pipe to remove that portion from the reactor system.

It has been found, however, that the particle size distribution in a fluidized bed, an important operating parameter, can be effectively controlled by recirculating part of this removed particulate material back to the furnace section. This is often accomplished by blowing air through the removed particulate material to strip away and entrain the finer portions of the particulate material and returning them to the furnace section.

For example, in U.S. Pat. No. 4,829,912, a patent assigned to the same assignee as the present application and incorporated herein by reference, a method of controlling the particle size distribution in a fluidized bed reactor is disclosed in which the particulate material removed from the furnace section is passed through jets of air to entrain the finer portions of the removed particulate material by stripping them away from the larger solids and then recirculating these finer portions back to the furnace section. The non-stripped, nonrecirculated particulate material is passed to an ash handling system for removal from the reactor system. However, since this nonrecirculated particulate material has a temperature which exceeds the design temperature of common ash handling systems, the material must be cooled prior to its passage to the ash handling system. In these types of arrangements, the heat removed from the nonrecirculated particulate material can be put to productive use, such as to preheat combustion supporting gas or for reheat or superheat duty.

A stripper/cooler located adjacent the furnace section of the reactor can both recirculate the finer portions of the removed particulate material and cool the removed but nonrecirculated particulate material. In these types of arrangements, a first, or stripper, section of the stripper/cooler receives the particulate material from the lower region of the fluidized bed through a drain pipe. Air is blown through the stripper section to strip, or entrain, some of the finer portions of the particulate material which portions are then returned to the furnace section. The particulate material remaining in the stripper/cooler is then usually passed to a second, or cooler, section of the stripper/cooler where heat is removed from the particulate material by passing water or steam in a heat exchange relation to the particulate material or by blowing air through it before it is discharged to the ash handling system.

The stripper/cooler system just described is not without its drawbacks. For example, a significant portion of the particulate material removed from the furnace section of the reactor will be noncombusted fuel due to the usually substoichiometric conditions maintained in the lower region of the fluidized bed from which the particulate material is removed. This leads to less than optimal combustion efficiency for the reactor system since the removed noncombusted fuel is not recirculated to the fluidized bed due to its relatively large size. It is therefore discharged through the ash handling system.

Further, as the particulate material is removed from the furnace section, it takes heat with it reducing the available heat in the furnace and requiring a cooling system to enable the ash handling system to manage the material. Moreover, duct work is required to return the stripped particulate material to the furnace section.

SUMMARY OF THE INVENTION

It is therefore an object of the present invention to provide a fluidized bed reactor and method which has an improved combustion efficiency.

It is a further object of the present invention to provide a fluidized bed reactor and method of the above type in which the heat content of the particulate material removed from the furnace section of the reactor is reduced.

It is a still further object of the present invention to provide a fluidized bed reactor and method of the above type in which the stoichiometry of a portion of the furnace section is controlled independently from the rest of the furnace section.

It is a still further object of the present invention to reduce the size of the stripper/cooler needed to receive particulate material from a fluidized bed reactor.

Toward the fulfillment of these and other objects, the reactor and method of the present invention provides an area of increased air flow into the portion of the fluidized bed which normally drains into a stripper/cooler or ash handling system. The air flow is increased by partitioning the plenum which fluidizes the bed and increasing the volume flow rate of fluidizing air passed into the draining portion of the bed. Alternatively, the air distributor nozzles which pass the fluidizing air from the plenum to the bed can be enlarged in the draining portion to decrease flow resistance and increase air flow.

BRIEF DESCRIPTION OF THE DRAWINGS

The above brief description as well as further objects, features and advantages of the present invention will be more fully appreciated by reference to the following detailed description of presently preferred but nonetheless illustrative embodiments in accordance with the present invention when taken in conjunction with the accompanying drawings in which.

DESCRIPTION OF THE PREFERRED EMBODIMENTS

Figure 1:
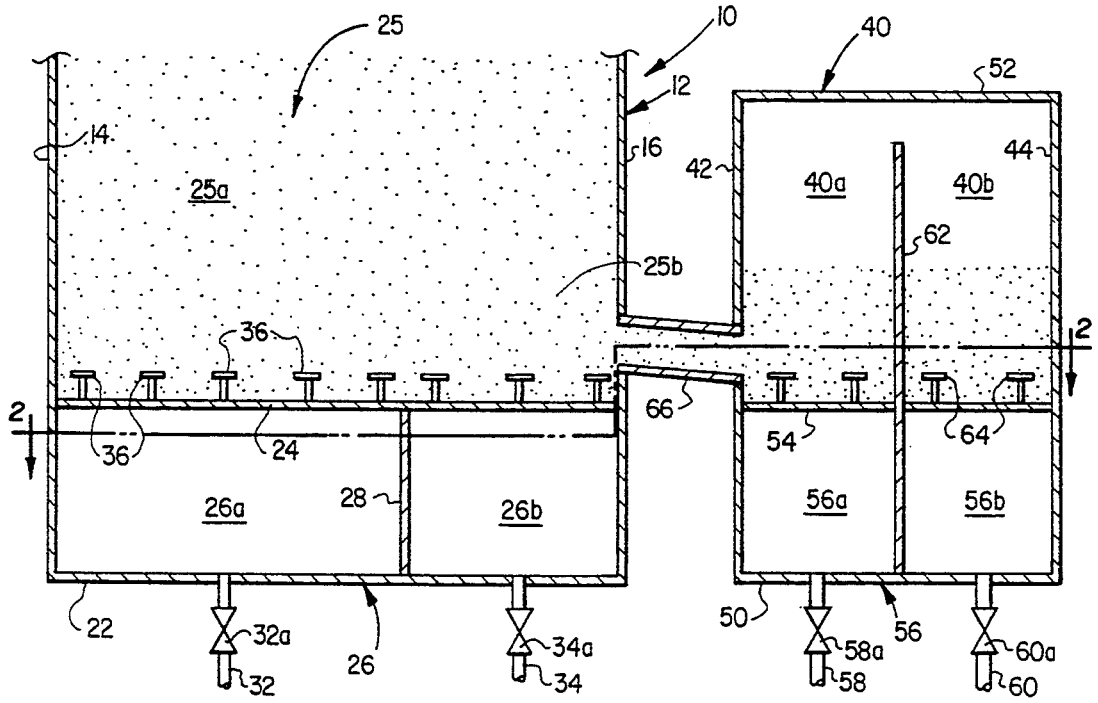
FIG. 1 is a sectional view of the fluidized bed reactor of the present invention.
Figure 2:
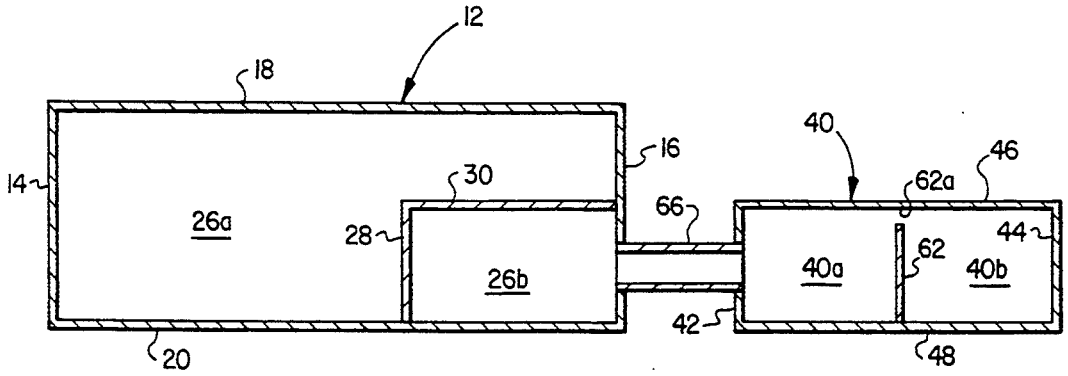
FIG. 2 is a cross-sectional view taken along the line 2—2 of FIG. 1.

FIG. 1 depicts the fluidized bed reactor of the present invention which is shown in general by the reference numeral 10. The reactor 10 includes a generally rectangular furnace section 12 which is defined by a walls 14, 16, 18 and 20 (FIG. 2). A plenum floor 22 is provided at the base of the furnace section 12 and a roof (not shown) completes the enclosure.

It is understood that if the reactor 10 is used for the purpose of steam generation, the walls 14, 16, 18 and 20 would be formed by a plurality of heat exchange tubes formed in a parallel, gas tight manner to carry a fluid to be heated, such as water. It is also understood that a plurality of headers (not shown) would be disposed at both ends of each of the walls 14, 16, 18 and 20 which, along with additional tubes and associated flow circuitry, would function to route the fluid through the reactor 10 and to and from a steam drum (not shown) in a conventional manner. These components are omitted in the drawings for the convenience of presentation.

A perforated plate 24 extends horizontally in the lower portion of the furnace section for supporting a bed of particulate material referred to in general by the reference numeral 25. The bed 25 consists of discrete particles of fuel material, such as bituminous coal, which are introduced into the furnace section 12 by a feeder or the like in any known manner. It is understood that a sulfur adsorbing material, such as limestone, can also be introduced into the furnace section 12 in a similar manner which material adsorbs the sulfur generated by the burning fuel.

It is also understood that a bed light-off burner (not shown) is mounted through the wall 14 above the plate 24 for initially igniting the bed 25 during start-up.

A plenum 26 is defined between the plate 24 and the floor 22 and is divided into two plenum sections **26*a* and 26*b* by two vertical partitions 28 and 30 (FIG. 2). Plenum section 26*a* receives pressurized gas, such as air, from an external source via a conduit 32 under control of a damper 32*a*. Plenum section 26*b* receives pressurized gas from an external source via a conduit 34 under control of a damper 34*a*. Thereby, the pressure within the plenum sections 28*a* and 28*b*** can be independently controlled for the reasons described below.

A plurality of nozzles 36 extend through perforations provided in the plate 24 and are adapted to discharge air from the plenum sections **26*a* and 26*b* into corresponding bed portions 25*a* and 25*b* of the bed 25 which extend immediately above the two plenum sections, respectively, for fluidizing the bed portions. Plenum section 26*b* is disposed beneath the bed portion 25*b* which is that portion of the fluidized bed 25 which normally drains into a stripper/cooler or ash handling system for removal from the furnace section 12. Thus, selective zonal fluidization of the bed portion 25*b* in relation to the rest of the bed 25 can be achieved by controlling the air entering the plenum chamber 26*b* by controlling the damper 34*a***, thereby creating a strip-air region within the fluidized bed.

The air passing through both of the bed portions **25*a* and 25*b*, whether from either plenum section 26*a* or 26*b*, fluidizes the bed 25 to promote combustion of the fuel and combines with the products of combustion to form combustion flue gases which rise by convection in the furnace section 12. The flue gases entrain a portion of the relatively fine particulate material in the furnace section 12** and pass downstream to a separating section (not shown) and a heat recovery section (not shown).

A cooler 40 is disposed adjacent the wall 16 of the furnace section 12, is generally rectangular in shape and is defined by walls 42, 44, 46 and 48 (FIG. 2), a floor 50 and a roof 52. Whereas the walls 42, 44, 46 and 48 are normally constructed of refractory lined plates, it is understood that if the reactor 10 is used for the purpose of steam generation, these walls could be formed by a plurality of heat exchange tubes in association with a plurality of headers and flow circuitry as previously described.

A plate 54 is disposed in the lower portion of the cooler 40 and extends horizontally in the same plane as the plate 24 and spaced from the floor 50 to form a plenum 56 therebetween, it being understood that the plate 54 need not be disposed in the same plane as the plate 24. Two conduits 58 and 60 receive gas, such as air, from an external source and communicate with the plenum 56 at spaced locations to independently control the pressure in various portions of the plenum 56 as will be described. Dampers **58*a* and 60*a* are disposed in the conduits 58 and 60**, respectively, to provide such independent control.

A vertical partition 62 extends upwardly from the floor 50 to divide the plenum 56 into two sections **56*a* and 56*b* and to divide the cooler 40 into a cooler section 40*a* disposed above the plenum section 56*a* and a cooler section 40*b* disposed above the plenum section 56*b*. A passage 62*a* (FIG. 2) is formed between the partition 62 and the wall 46 to allow particulate material in the cooler section 40*a* to pass to the cooler section 40*b***.

The plate 54 is perforated and receives a plurality of nozzles 64 which are directed to discharge air from the plenum 56 to fluidize particulate material in the cooler sections **40*a* and 40*b* and direct the material from the cooler section 40*a*, through the passage 62*a*, to the cooler section 40*b* and toward a drain pipe (not shown) extending through an enlarged opening in the plate 54 and connecting with the cooler section 40*b***.

A relatively large, generally horizontal duct 66 connects an opening formed in the wall 16 of the furnace section 12 to a corresponding opening formed in the adjacent wall 42 of the cooler 40 to permit the particulate material in the bed section **25*b* of the furnace section 12 to pass into the cooler section 40*a* of the cooler 40**.

In operation, particulate fuel material and adsorbent are introduced into the furnace section 12 and accumulate on the plate 24. Air from an external source passes into the plenum 26 via the air conduits 32 and 34, through the plate 24 and the nozzles 36, and into the particulate material on the plate to fluidized the bed 25.

The light-off burner (not shown) or the like is fired to ignite the particulate fuel material in the bed 25. When the temperature of the material in the bed 25 reaches a predetermined level, additional particulate material is continuously discharged onto the upper portion of the bed 25. The air promotes the combustion of the fuel and the velocity of the air is controlled by the dampers 32*a* and 34*a* to exceed the minimum fluidizing velocity of the bed 25. The volume flow rate of the air introduced via the nozzles 36 is also controlled to operate the lower region of the bed 25 under substoichiometric conditions to decrease the production of pollutants. To complete the combustion of the fuel, secondary air is supplied through air ports (not shown) into the upper region of the furnace section 12.

As the fuel burns and the adsorbent particles are reacted, the continual influx of air through the nozzles 36 creates a homogenous fluidized bed 25 of particulate material including unburned fuel, partially-burned fuel, and completely-burned fuel along with unreacted adsorbent, partially-reacted adsorbent and completely-reacted adsorbent.

Particulate material is drained from the bed portion 25*b* through the duct 66 to provide room for fresh fuel and adsorbent. The air flow into the bed portion 25*b* is maintained at a greater level than into the remainder of the fluidized bed 25, i.e. bed portion 25*a*, by adjusting the dampers 32*a* and 34*a*, respectively. This increased air flow into the bed portion 25*b* strips the relatively fine particulate material from the draining solids, preventing these finer particles from entering the duct 66. The increased air flow also increases the percentage of oxygen in the bed portion 25*b* relative to the rest of the lower region of the bed 25 which results in increased combustion of the fuel. A third effect of the increased air flow into the bed portion 25*b* is the increased transference of heat from the particulate material in the bed portion 25*b* to the flue gases.

The damper 58*a* is opened as desired to introduce air into the cooler section 40*a* of the cooler section 40, via the plenum section 56*a*, to promote the flow of particulate material from the bed portion 25*b* to the cooler section 40 through the duct 66. The nozzles 64 are directed to discharge the air to urge the particulate material in the cooler section 40*a* and around the partition 62, which partition functions to increase the residence time of the particulate material in the cooler 40 before passing, via a drain pipe (not shown) communicating with the cooler section 40*b*, to the ash handling system (not shown). The velocity of the air and therefore the degree of flow of the particulate material into the cooler 40 and the degree of fluidization and cooling required are respectively controlled as needed by varying the position of the dampers 58*a* and 60*a*. The relatively cool air passing through the particulate material in the cooler 40 removes heat from the material and can be used as secondary combustion air in the furnace section 12 or in other ways, with proper openings and passages being added to the structure as needed. In addition, the heat resident in the particulate material in the cooler 40 can be transferred to a heat transfer fluid in either the walls of the cooler 40 or in a heat exchanger (not shown) disposed in the cooler 40.

It is thus seen that the device and method of the present invention provides several advantages. For example, by partitioning the plenum 26, the stoichiometry of the bed portion 25*b* drained from the furnace section 12 can be controlled independently from the rest of the furnace section. Thus, the air flow to the bed portion 25*b* can be increased to increase the stoichiometric conditions in the bed portion without affecting the substoichiometric conditions in the rest of the bed 25. By increasing the stoichiometric conditions within the bed portion 25*b*, combustion is enhanced, resulting in less unburned fuel being removed from the furnace section 12. Further, the increased air flow strips away the relatively fine particulate material in the bed portion 25*b* and prevents it from draining. Therefore, the cooler 40 does not need a stripper section or the associated duct work needed to convey the stripped material back to the furnace section, thereby reducing the size and cost of the reactor system. In addition, the increased air flow cools the particulate material in the bed portion 25*b* by transferring its heat to the flue gases thereby reducing the amount of cooling required before passing the removed material to the ash handling system.

Figure 3:
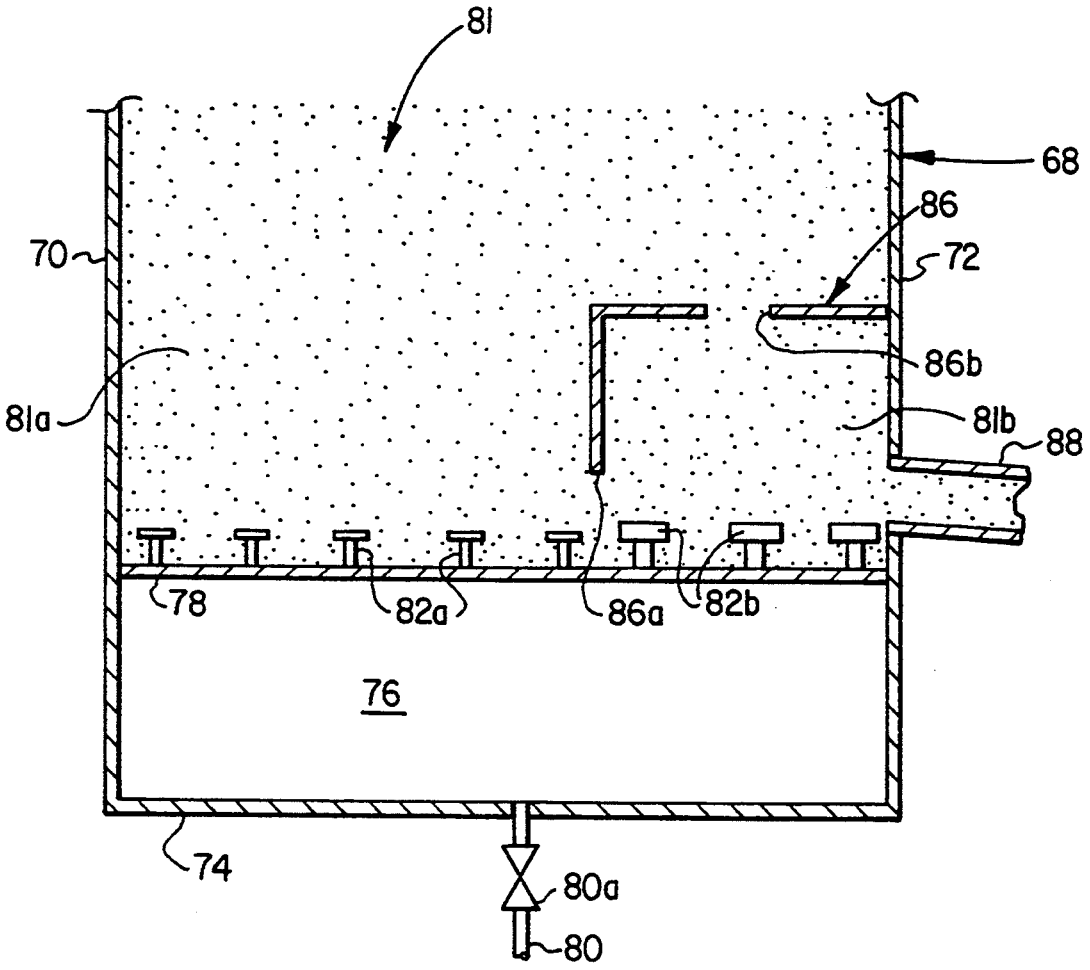
FIG. 3 is a view similar to FIG. 1 but depicting an alternative embodiment of the present invention.

An alternative preferred embodiment of the fluidized bed reactor and method of the present invention is shown in FIG. 3. A furnace section 68 is provided which is similar to the furnace section 12 and is defined by walls 70 and 72 and two walls (not shown). A floor 74 is provided at the base of the furnace section 68 and a roof (not shown) completes the enclosure.

A plenum 76 is formed in the lower portion of the furnace section 68, defined between the floor 74 and a perforated plate 78. In distinction from the previous embodiment, the plenum 76 is not partitioned and receives fluidizing air from a single conduit 80 under control of a damper 80*a*.

A bed 81 of particulate material having bed portions 81*a* and 81*b* is supported by the plate 78. Two sets of nozzles 82*a* and 82*b* extend through perforations provided in the plate 78 and are adapted to discharge air from the plenum 76 into the bed portions 81*a* and 81*b*. As shown in FIG. 3, the nozzles 82*b* fluidize the bed portion 81*b* and the nozzles 82*a* fluidize the bed portion 81*a*. The nozzles 82*b* have a larger cross-sectional area than the nozzles 82*a* and thus have a lower resistance to air flow than the nozzles 82*a* causing a higher volume flow rate of air to pass through them as compared to the nozzles 82*a*. Selective zonal fluidization of the bed portion 81*b* in relation to the rest of the bed 81, i.e. bed portion 81*a*, is thereby achieved by a passive system.

A refractory lined enclosure 86 is provided around the bed portion 81*b* to partition the bed portion 81*b* from the bed portion 81*a*. Suitable openings 86*a* and 86*b* are formed in the enclosure 86 to allow for the passage of particulate material and air between the bed portions 81*a* and 81*b*.

A cooler (not shown), identical to the cooler 40, is disposed adjacent the furnace section 68 to receive particulate material from the bed portion 81*b* via a duct 88 in the manner and for the purposes described above with respect to the preceding embodiment.

In operation, the embodiment shown in FIG. 3 functions essentially in the same way as the previous embodiment, the only difference being in the manner in which the air flow is increased to the bed portion 81*b*. As described above, by reducing the flow resistance into the bed portion 81*b*, the volume flow rate of fluidizing air is increased which strips the relatively fine particulate material, increases the stoichiometric conditions, and cools the draining material, without having to partition the plenum 76 and independently control the air flow to each plenum section.

Thus, this alternative preferred embodiment provides all of the above-mentioned advantages of the previous embodiment while reducing the number of necessary components. The addition of the enclosure 86 provides the extra benefit of reducing the interaction between the bed portion 81*b* and the remainder of the fluidized bed 81.

It is understood that variations may be made in the foregoing without departing from the scope of the invention. For example, a combination of the active control of the embodiment of FIGS. 1 and 2 and the passive control of FIG. 3 can be used to form the strip-air section within the fluidized bed. In addition, the enclosure 86 of the embodiment of FIG. 3 can be incorporated into the embodiment of FIGS. 1 and 2, and can be formed by a plurality of heat exchange tubes in association with flow circuitry for generating steam. Further, the ducts 66 and 88 can be replaced by a generally vertical duct extending downwardly from the bed portions 25*b* and 81*b*, respectively, and the cooler disposed beneath the corresponding furnace section.

Other changes and substitutions are intended in the foregoing disclosure and in some instances some features of the invention will be employed without a corresponding use of other features. Accordingly, it is appropriate that the appended claims be construed broadly and in a manner consistent with the scope of the invention.

What is claimed is:

1. A fluidized bed reactor, comprising:

a furnace section;

means for supporting a bed of particulate material in said furnace section;

a plenum extending immediately below said supporting means;

means extending above said supporting means for partitioning said bed into two bed portions, said partitioning means having openings to allow passage of said particulate material between said bed portions; and means for passing gas from said plenum through corresponding portions of said supporting means and into said two bed portions at different gas flows to selectively fluidize said bed portions;

means for removing from said furnace section particulate material in one bed portion having a greater gas flow than another bed portion; and a vessel for receiving said removed particulate material, said vessel including means for cooling said removed particulate material.

2. A fluidized bed reactor, comprising:

a furnace section;

means for supporting a bed of particulate material in said furnace section;

means extending above said supporting means for partitioning said bed into two bed portions, said partitioning means having openings to allow passage of said particulate material between said bed portions;

means for fluidizing said bed portions with gas, said fluidizing means delivering a greater amount of gas to one bed portion than to the other bed portion;

means for removing from said furnace section particulate material from one of said bed portions; and a vessel for receiving said removed particulate material, said vessel including means for cooling said removed particulate material.

3. The fluidized bed reactor of claim 1 wherein said passing means comprises means for partitioning said plenum into a first portion extending below said one bed portion and a second portion extending below said other bed portion.

4. The fluidized bed reactor of claim 3 further comprising:

a first air conduit under control of a first damper for supplying gas from an external source to said first portion of said plenum; and a second air conduit under control of a second damper for supplying gas from an external source to said second portion.

5. The fluidized bed reactor of claim 1 wherein said passing means comprises means for decreasing the flow resistance to the gas flow passing into said one bed portion.

6. The fluidized bed reactor of claim 1 wherein said passing means comprises:

a first set of nozzles which extend from said plenum through said supporting means to supply gas to said one bed portion; and a second set of nozzles which extend from said plenum through said supporting means to supply gas to said other bed portion, said first set of nozzles having a larger cross-sectional area than said second set of nozzles to cause a higher volume gas flow rate to pass through said first set of nozzles.

7. The fluidized bed reactor of claim 2 wherein said fluidizing means comprises a plenum immediately below said supporting means.

8. The fluidized bed reactor of claim 7 further comprising means for partitioning said plenum to selectively fluidize said bed portion and said remaining bed portion.

9. The fluidized bed reactor of claim 7 wherein said fluidizing means comprises nozzles which extend from said plenum through said supporting means to supply gas to said bed, the portion of said nozzles delivering gas into said bed portion having a relatively larger cross-sectional area than the nozzles delivering gas to said remaining bed portion.

* * * * *